US005921794A

United States Patent [19]

Koch

[11] Patent Number: 5,921,794

[45] Date of Patent: Jul. 13, 1999

[54] CONNECTOR WITH INTEGRAL SWITCH ACTUATING CAM

[75] Inventor: Richard M. Koch, Wakefield, Mass.

[73] Assignee: Tru-Connector Corporation, Peabody, Mass.

[21] Appl. No.: 09/128,203

[22] Filed: Aug. 3, 1998

Related U.S. Application Data

[63] Continuation-in-part of application No. 08/937,574, Sep. 25, 1997.

[51] Int. Cl.[6] ..... H01R 29/00

[52] U.S. Cl. ..... 439/188; 200/51.09

[58] Field of Search ..... 439/188, 318, 439/489, 911; 200/51.1, 51.09

[56] References Cited

U.S. PATENT DOCUMENTS

| | | | |
|---|---|---|---|
| 2,986,612 | 5/1961 | Healy | 439/188 |
| 3,843,854 | 10/1974 | Mori et al. | 439/188 |
| 3,960,428 | 6/1976 | Naus et al. | 200/51.09 |
| 5,140,659 | 8/1992 | Minds et al. | 439/188 |
| 5,286,213 | 2/1994 | Altergott et al. | 439/188 |

OTHER PUBLICATIONS

Tru–Connector Corp. product description for "Type SQ RF Connectors" dated Jun. 6, 1994; 2 pages.

*Primary Examiner*—Neil Abrams
*Assistant Examiner*—T C Patel
*Attorney, Agent, or Firm*—Donald J. Perreault

[57] ABSTRACT

An electrical connector including an outer shell, and an integral rotatable cam shell positioned over the outer shell. The cam shell has at least one switch actuating cam extending radially from an outer surface thereof. Upon mating of the connector with a mating connector assembly, the cam shell is rotated to cause the cam to contact a switch and thereby change the switch from an open state wherein current flow through the connector is interrupted to a closed state wherein current is allowed to flow through the connector and the mating connector. Preferably, the connector further includes a spring positioned between the outer shell and the cam shell. The spring biases the cam shell against the outer shell axially in a direction away from the mating connector.

12 Claims, 3 Drawing Sheets

CONNECTOR WITH INTEGRAL SWITCH ACTUATING CAM

CROSS REFERENCE TO RELATED APPLICATIONS

The present application is a continuation-in-part of co-pending U.S. application Ser. No. 08/937,574, filed Sep. 25, 1997, the teachings of which are incorporated herein by reference.

FIELD OF THE INVENTION

The present invention relates in general to electrical connectors, and in particular to an electrical connector for a coaxial cable which includes an integral switch actuating cam which trips an external switch upon connection to a mating connector assembly.

BACKGROUND OF THE INVENTION

In high frequency and high power electrical applications, the application of power to associated equipment involves inherent risks which are of a constant concern to both manufacturers and users of such equipment. Power must be applied in a manner which will not damage the equipment, and in a manner which provides a safe environment for users. For example, when high power (i.e. kilowatts) RF signals are transmitted along a cable which is disconnected from a load, i.e. on an open circuit, the energy may be reflected back to the signal source, thereby destroying the same. Also, if a conducting material is in close proximity to the end of the cable through which the high power signal is applied, the signal may arc across an air gap to the conducting material. This could cause serious risks of electrical shock, equipment damage, or fire.

Another concern relates to the risk of electrical shock to the users of the high power equipment. When power is applied along a cable which is disconnected from a load, it is possible that a user may come into physical contact with the "hot" end of the cable. This can occur, for example, through the inadvertent direct contact with the center conductor of the cable, or by inadvertent contact of a hand tool with the center conductor. Regardless of the manner of contact, however, sufficient power to seriously injure or kill a person is frequently applied to the cable. Prevention of contact with the center conductor of the cable is, therefore, of extreme importance.

To date, users of high-power RF equipment have generally been left to their own resources to limit the risks associated with the application of a high power signal to an open circuit. Most users are highly cognizant of the risks, and are careful to connect a load to a signal source before applying power. Human error and accident, however, frequently result in serious injury to users and damage to equipment.

There is, therefore, a need in the art for electrical connectors, particularly connectors for use in high power RF applications, which are capable of switching the RF signal source off when the connection between the signal source and the load is removed.

OBJECTS OF THE INVENTION

A primary object of the present invention is to provide a connector with an integral switch actuating cam which trips an external switch to allow electrical current to flow through the connector only when the connector is mated with a mating connector assembly.

Another object of the present invention is to reduce the hazard of inadvertent shock associated with high power electrical applications.

Yet another object of the present invention is to provide a connector with an integral switch actuating cam for tripping an external switch which is of a simple and cost-efficient design.

Still another object of the present invention is to provide a connector with an integral switch actuating cam for tripping an external switch which is easily assembled.

These and other objects of the present invention will become apparent from a review of the description provided below.

SUMMARY OF THE INVENTION

The electrical connector of the present invention is organized about the concept of providing a connector having an integral switch actuating cam which trips a normally-open external switch for controlling the application of power through the connector. Thus, when the connector of the present invention is connected to a mating connector assembly, the signal source is switched to the connector by the contact of the cam against the external switch. When the mating connector is removed, the cam contacts the switch to return the switch to its normally open state and disconnect the signal source from the connector. A signal can be provided from the signal source to the connector, therefore, only when a mating connector assembly is mated with the connector of the invention. All risks of injury and damage to equipment are eliminated.

Specifically, the connector of the present invention includes: an outer shell; and a cam shell disposed over the outer shell. The cam shell includes at least one switch actuating cam extending radially from an outer surface thereof. Upon mating of the connector with a mating connector, the cam shell is adapted to be rotated for thereby causing the cam to contact a switch, and thereby change the switch from an open state wherein current flow from the mating connector through a center conductor of the connector is interrupted, to a closed state wherein current is allowed to flow from the mating connector through the center conductor.

Preferably, a cam shell spring is disposed between the outer shell and the cam shell. The cam shell spring biases the cam shell axially in a direction away from a mating end of the connector which is adapted to mate with the mating connector. The cam shell is axially extendable relative to the outer shell against the bias of the cam shell spring to facilitate insertion of the cam shell into the housing of a mating connector assembly. In the preferred embodiment, the cam shell spring has a first end positioned against a shelf formed on a retainer ring fixed to the outer shell and a second end positioned against a shelf formed on the cam shell.

The connector also preferably includes an inner shell. The outer shell is disposed about the inner shell, and is axially biased toward the mating end of the connector by a spring disposed between the inner shell and the outer shell. The inner shell includes portions defining openings therein. Locking elements are disposed within the openings, with portions thereof being forced radially inward beyond an inner surface of the inner shell by a first surface of the outer shell. The outer shell includes a beveled surface adjacent the first surface. Upon axial movement of the outer shell away from the mating end, the beveled surface aligns with the openings thereby allowing the locking elements to recede within the openings against the beveled surface for mating the connector with the mating connector.

BRIEF DESCRIPTION OF THE DRAWINGS

For a better understanding of the present invention, together with other objects, features and advantages, reference should be made to the following description of the preferred embodiment which should be read in conjunction with the following figures wherein like numerals represent like parts.

DETAILED DESCRIPTION OF THE INVENTION

The present invention will now be described in connection with a preferred embodiment which is adapted for use with a mating connector assembly mounted to an instrument panel, or the like. Advantageously, the connector includes a switch actuating cam which trips an external switch mounted in the mating connector assembly for controlling the flow of current through the connector in dependence of whether the connector is secured to the mating connector assembly. For ease of explanation, the invention will be described herein in connection with a particular preferred embodiment, i.e., a right-angle connector design. Those skilled in the art will recognize, however, that the advantages of the invention could be incorporated into many connector designs. It is intended, therefore, that the invention not be limited to the specific embodiment described, but include any variation thereof associated with use in varied connector schemes and designs.

Figure 1:
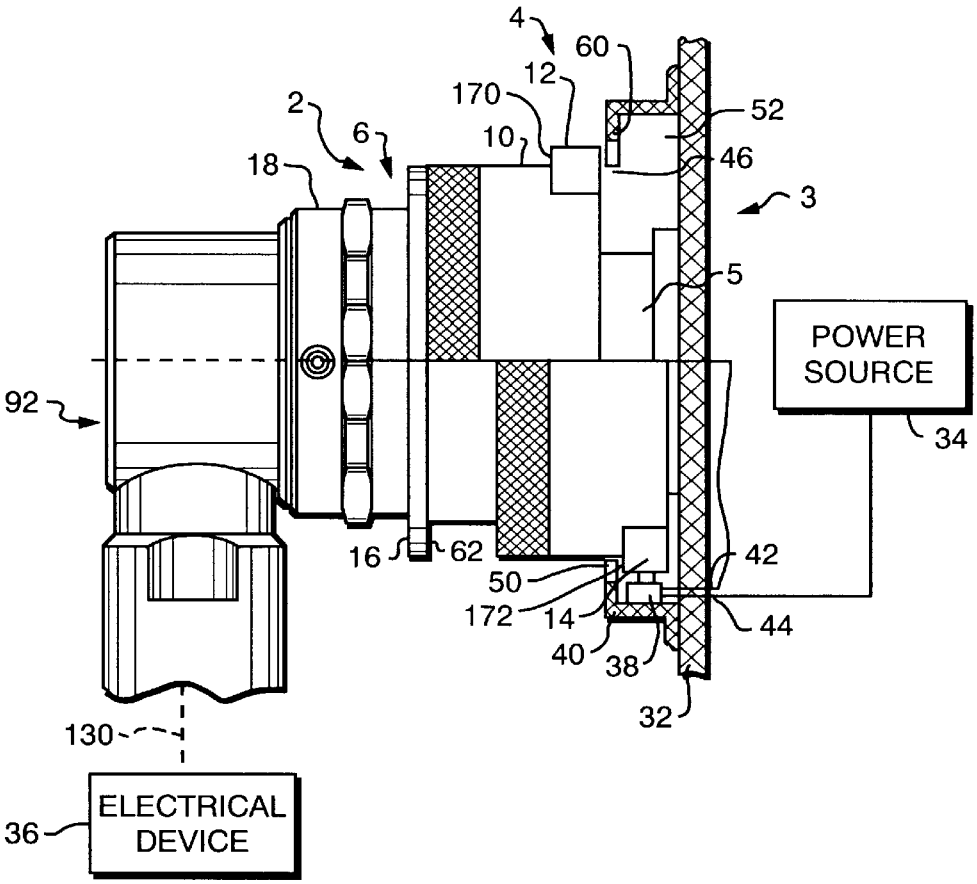
FIG. 1: is a side plan view of one embodiment of a connector according to the invention with a right angle adaptor connected thereto wherein the top portion of the figure shows the connector in an unmated condition and the bottom portion of the figure shows the connector in a mated condition.
Figure 2:
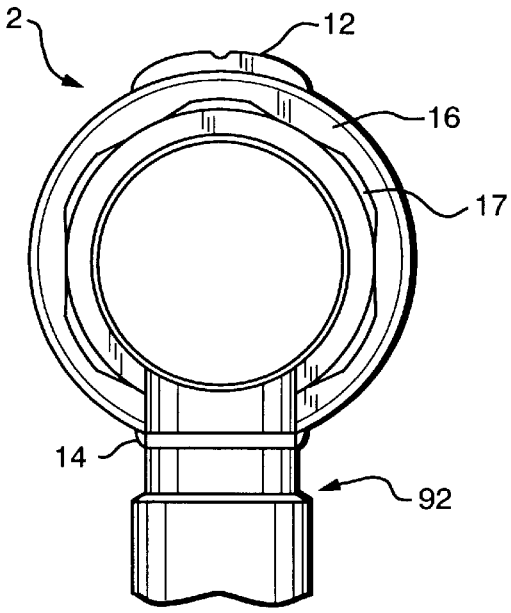
FIG. 2: is an end view of the connector shown in FIG. 1.

Referring now to FIGS. 1 and 2 of the drawing, there is shown a preferred connector 2 according to the present invention which will be described first in general terms, with more detailed description to follow. The connector 2 generally has a first end 4 and a second end 6. The first end 4 is provided with male or female receptacle for matingly engaging a corresponding mating connector 5 disposed within a mating connector assembly 3 mounted to an instrument panel 32 or the like. The mating connector assembly includes a normally-open switch 38 which controls the flow of current from an electrical power source 34 through a center conductor of the mating connector 5. The second end 6 of the connector 2 is adapted to be electrically connected to an electrical device 36, e.g., through appropriate cables 130.

Advantageously, the connector 2 includes at least one switch actuating cam 12,14 on the end 4 of the cam shell 10 for tripping the normally-open switch 38 mounted within the matting connector assembly. The switch includes leads 42,44 which are connected between the electric power source 34 and the center conductor of the mating connector 5 so that the switch state, i.e. open or closed, controls the flow of current through the mating connector. When the connector 2 is joined with the mating connector assembly 3, one of the switch actuating cams 12 or 14 contacts the switch to close the electrical connection from the power source 34 to the electrical device 36 through the connector 2 and the mating connector 5.

When the connection between the connector 2 and the mating connector assembly is removed, the cam shell 10 is rotated causing the cam 12 or 14 to reset the switch to its normally-open state wherein current flow through the from the power source to the mating connector 5 is interrupted. Advantageously, therefore, current is supplied through the mating connector from the power source 34 only when the cam 12 or 14 of the connector 2 is inserted within the housing and rotated to trip the switch 38. The dangers of inadvertent shock or damage to equipment associated with providing an open connection to a power source are, therefore, eliminated.

Figure 3:
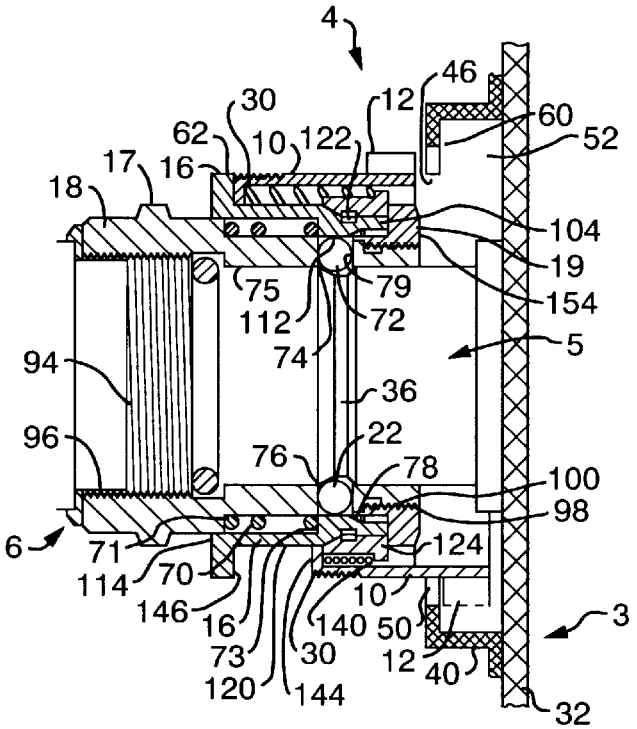
FIG. 3: is a sectional view of the connector shown in FIG. 1 wherein the top portion of the figure shows the connector in an unmated condition and the bottom portion of the figure shows the connector in a mated condition.
Figure 4:
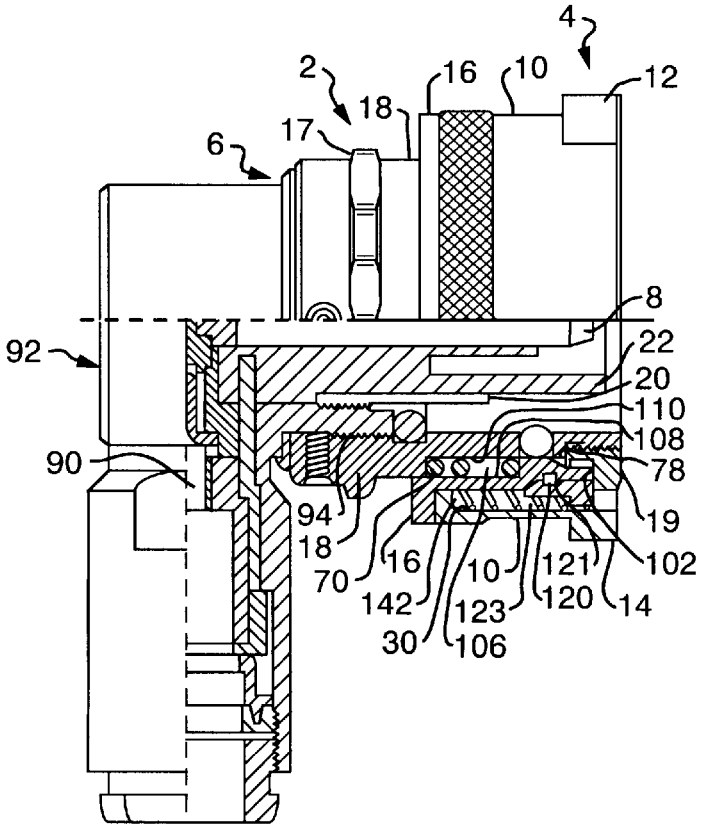
FIG. 4: is a sectional view of the connector shown in FIG. 1 wherein the top portion of the figure shows the connector in an unmated condition and the bottom portion of the figure shows the connector in a mated condition.

Turning now to FIGS. 3 and 4, there is shown a preferred embodiment of a connector according to the invention with a rotatable cam shell incorporated into a ball-locking type mating connection. It is to be understood, however, that other types of mating connections and methods would be readily apparent to those skilled in the art. For example, instead of the ball-locking mechanism of the preferred embodiment, a threaded connection may be used. Other types of connections and connection methods will be readily apparent to those skilled in the art.

In the preferred embodiment, the connector 2 generally includes: a rotatable cam shell 10 with first 12 and second 14 switch actuating cams thereon; a retainer ring 124; a outer shell 16; an inner shell 18; a cam shell biasing spring 30; an insulator 22; a center conductor 8, an end shell 19, a compression spring 70, and ball bearing locking elements 72. The cam shell, inner shell, end shell and retainer ring are preferably machined from brass and plated with nickel. The center conductor is preferably formed from brass and plated with silver. The insulator is preferably formed from a known insulating material such as TEFLON.

As shown, the center conductor 8 is disposed in a fixed axial position in a bore in the insulator 22, and is electrically connected to a conductor 90 received within a known right angle adaptor 92. The right angle adaptor includes threads 94 on an end thereof which mate with threads 96 on an inner surface of the inner shell portion to secure the mating connector to the right angle adaptor.

The inner shell 18 is generally cylindrical in shape, and is formed with portions defining openings 74,76 in the walls thereof which are sized to receive the ball bearing locking elements 72. The portions defining the openings include beveled inner surfaces 79 which cause the diameter of the openings to diminish toward the inner surface 75 of the inner shell. The ball bearing locking elements, therefore, may be received within a top portion of the openings, but the bottom portions of the openings have diameters which allow only a portion of the ball bearing locking elements to extend inward beyond the inner surface 75 of the inner shell.

The inner shell includes a rear portion with a circumferential projection 17 on the exterior surface thereof. A shelf 71 is formed on the exterior of the inner shell portion. The shelf provides a surface against which the bottom of the cylindrical compression spring 70 rests. The top of the compression spring engages a shelf 73 formed on the interior of the generally cylindrical outer shell 16 which is disposed around the front portion of the inner shell.

The end shell 19 includes threads 98 which mate with corresponding threads 100 on the end of the exterior surface of the inner shell. The end shell includes an enlarged diameter portion which defines a shelf 102 for engaging the front end surface 104 of the outer shell.

In assembling the mating connector, the threads 98 on the end shell are mated with the threads 100 on the inner shell and the end shell is rotated relative to the inner shell. As the end shell is threaded onto the inner shell, the shelf 102 on the end shell engages the end 104 of the outer shell to thereby force the outer shell axially reward against the bias of the compression spring 70. The compression spring, therefore, continuously biases the outer shell against the shelf 102 of the end shell by imposing a spring force against the shelf 73 on the interior surface of the outer shell. The spring force of the compression spring is selected so that it may be overcome by physically forcing the outer shell axially rearward in the direction of end 6 of the mating connector.

The inner surface 108 of the outer shell, in connection with an opposed outer surface 110 of the inner shell, defines a cavity 106 in which the compression spring is disposed. The inner surface 108 of the outer shell includes a flat portion 112 which is normally positioned directly over the openings 74,76. This flat portion forces the ball bearings radially inward so that portions thereof extend radially inward beyond the inner surface 75 of the inner shell, as shown in FIG.4. A beveled portion 78 of the inner surface is positioned adjacent the openings toward the forward end 4 of the connector.

In the preferred embodiment, the retaining ring 124 is disposed around the forward end of the outer shell 16. The retainer ring includes a groove 118 therein which axially corresponds with a groove 122 formed in the outer surface 120 of the outer shell. A gasket 121 is disposed within the groove 120, and extends into the groove 118 to lock the retainer ring in position relative to the outer shell.

The cam shell 10 is disposed around the outer shell 16 and retainer ring 124. A cam shell compression spring 30 is disposed in a cavity 123 defined by the cam shell and the outer surface of the outer shell. The spring 30 is compressed between a shelf 140 formed on the retainer ring 124 and shelf 142 formed on the cam shell 10. The cam shell spring biases the cam shell toward the rear end 6 of the connector 2 so that the end surface 144 of the cam shell is normally forced against the shelf 146 formed on the outer surface of the outer shell.

Figure 5:
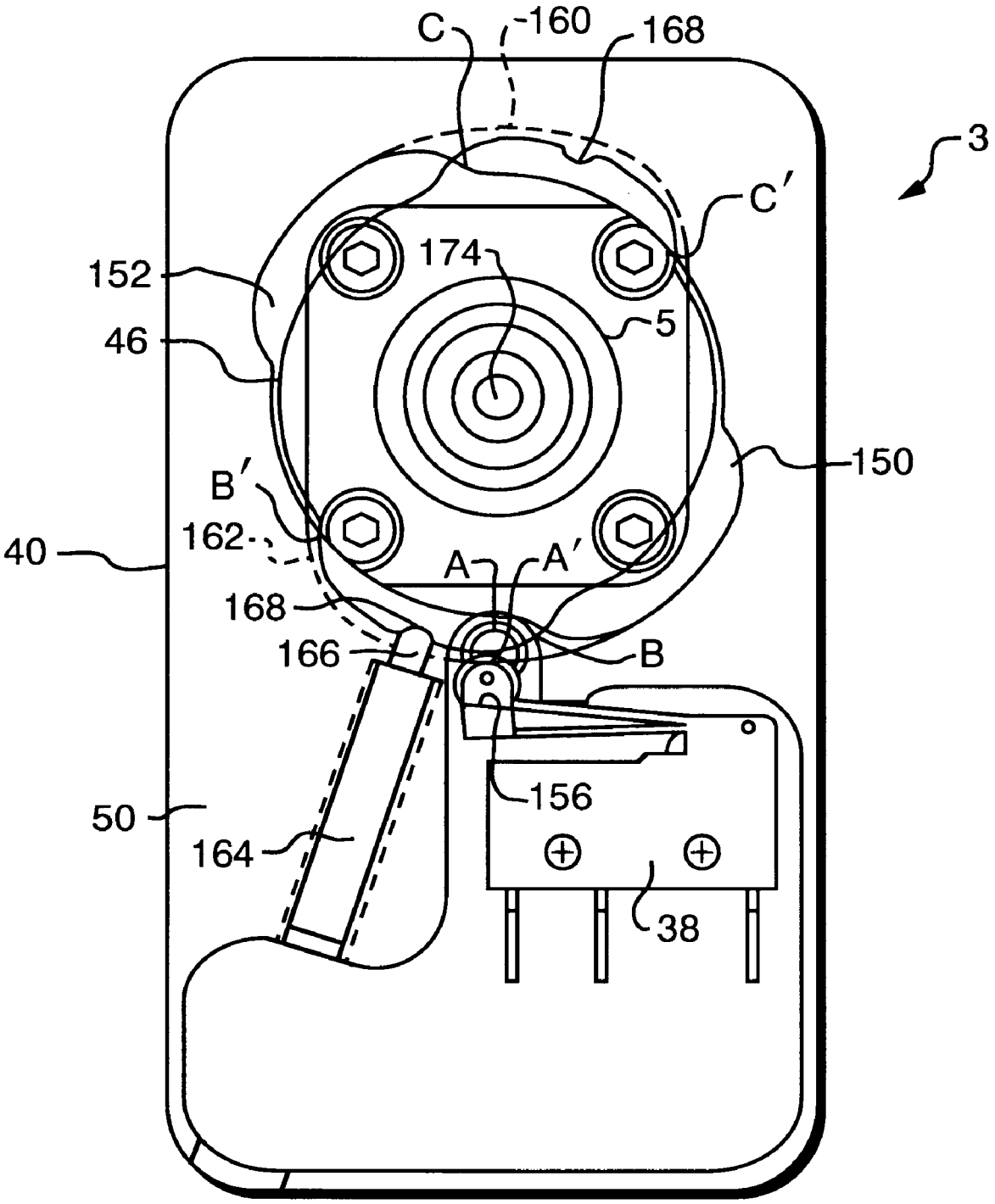
FIG. 5: is a front cut-away view of a mating connector assembly according to the invention showing the mating connector and the switch therein, and showing the cam shell in a first position wherein the switch arm of the switch has not been depressed by a cam and in a second position wherein the switch arm has been depressed by a cam.

As shown particularly in FIG. 5, the mating connector assembly 3 includes the mating connector 5 for receiving the connector 2. The mating connector is disposed within the housing 40, and is positioned centrally relative to an opening 46 in the outer housing wall 50. The opening 46 is shaped to generally conform to the dimensions of the end of the cam shell so that the cam shell may be received therein.

Thus, in order to mate the connector 2 with the mating connector 5, the cams 12, 14 must be aligned with corresponding radially extended portions 150,152, of the opening 46. The cam shell 10 with the cams 12 and 14 thereon is then forced axially forward relative to the outer shell 16 in the direction of the end 4 against the force a biasing spring 30. The cam shell thus extends axially forward to extend beyond the end surface 154 of the end shell 19 to allow insertion of the cams through the opening 46 and into space 52 defined by the housing 40, as shown in the bottom portions of FIGS. 1 and 3. In the initial position, when the cams are disposed within the space 52, they are positioned so that a leading edge of cam 14 is disposed in a position B adjacent the switch contact 156 which is in a position A. The leading edge of cam 12 is at position C. With the cams 12, 14 in positions C and B, respectively, the switch contact has not been depressed, and the switch is in its normally open state.

The cam shell then is rotated relative to the inner shell 18 so that the leading edges of the cams 14, 12 travel along the dotted lines 160,162 within the space 52 from points B and C to points B' and C', respectively. As the leading edge of cam 14 travels from points B to B' the cam 14 contacts and depresses the switch contact 156 to position A', thereby closing the normally open switch and facilitating current flow from the power source through the connectors 2 and 5 and to the electrical device.

In order to maintain the cam shell in position with the cam 14 forcing the switch contact to position A', a spring operated detent 164 is mounted within the mating shell assembly. The detent has a head 166 which moves axially relative to the detent body. As the cam shell is rotated, the leading edge of the cam 14 depresses the head 166. As the cam travels over the head, the head becomes disposed over a dimple or groove 168 in the cam. The head 166 then extends axially from the detent body into the groove 168. The engagement of the detent with the groove provides resistance against further rotation of the cam shell to resist inadvertent over-rotation of the cam shell, whereby the switch arm could lose contact with the cam thereby returning the switch to its normally-open state. Rotation of the cam shell 10 to the leading edge positions B' and C' also locks the cam shell in the housing by engagement of the rear surfaces 170,172 (FIG. 1) of the cams 12,14 with the bottom surface 60 of the top panel 50 of the housing 40.

Once the cam shell and cams 12, 14 are inserted into the housing 40 and the switch 38 is tripped, the outer shell can then be accessed for making the connection with the mating connector. In the embodiment shown, the connection between the connector 2 and the mating connector 5 of the mating connector assembly 3 is established by retracting the outer shell 16 toward end 6 of the mating connector and against the bias of the compression spring 70 until the end 114 of the outer shell contacts the projection 17. This action brings the beveled inner surface 78 of the outer shell into alignment with the openings 74,76, thereby allowing the ball bearing locking elements to recede inward relative to the inner surface 75 of the inner shell and against the beveled inner surface of the outer shell.

Once the ball bearings are free to recede into the openings toward the outer shell and beyond the inner surface 75 of the inner shell, the connector 2 is positioned over the mating connector 5 until the locations of the ball bearings correspond axially with the location of the groove 36 in the mating connector. Correspondingly, the center conductor 8 of the connector 2 aligns with, and electrically contacts, the center conductor 174 of the mating connector 5 to create an electrical path through the connector 2 and the mating connector 5.

The outer shell 16 is then released and the compression spring forces the outer shell in the direction of end 4 of the mating connector, thereby causing the flat portion 112 of the outer shell to force the bearings 72 outward relative to the inner surface 75 of the inner shell and into the groove 36 in the connector 3, as shown particularly in FIG. 3. The engagement of the ball bearings with the groove locks the connector 2 to the mating connector 5.

To remove the connector 2 from the mating connector, the cam shell is rotated so that the leading edges of the cams return to positions B and C. The cam 14 is thus removed from contact with the switch 156, and the switch returns to its normally "open" state at position A. The outer shell is then retracted toward the end 6 against the bias of the compression spring, and the connector 2 is forced axially toward the end 6 to withdraw the cam shell from the opening 46.

With this construction, it is possible to connect an electrical signal to the center conductor of the connector 2 only when the connector 2 is mated with the mating connector assembly. Accordingly, electric current is never provided to the mating connector 5 from the power source when the center conductor 174 is exposed for inadvertent contact.

There is thus provided an electrical connector which eliminates the hazards associated with providing a high-power electrical signal to an unmated connector. The connector includes an outer shell, and an integral rotatable cam shell positioned over the outer shell. The cam shell has at least one switch actuating cam extending radially from an outer surface thereof. Upon mating of the connector with a mating connector assembly, the cam shell is rotated to cause the cam to contact a switch and thereby change the switch from an open state wherein current flow to the mating connector is interrupted to a closed state wherein current is allowed to flow through the mating connector and the connector.

Preferably, the connector further includes a spring positioned between the outer shell and the cam shell. The spring biases the cam shell against the outer shell axially in a direction away from the mating connector. Upon withdrawal of the mating connector, the switch returns to its normally "open" state, thereby disconnecting the electrical connection between the center conductor of the mating connector and the electric signal source. The risks of personal injury or damage to equipment resulting from inadvertent contact with the end of the center conductor of the mating connector, or from arcing of an electrical signal from the center conductor, are, therefore, eliminated in a simple and cost-efficient design.

The embodiments described herein, are but some of several which utilize this invention, and are set forth here by way of illustration but not of limitation. For example, any number of internal switches could be provided in the mating connector assembly, and several component parts of the connector and/or the mating connector assembly could be combined into unitary pieces. Also, any number of cams could be used on the outer surface of the cam shell. If an overall reduced diameter were desired for the connector, the cam shell could be extended forward of the end shell and reduced in diameter with the cams extending from the reduced diameter portion of the cam shell. Moreover, it would be readily apparent to those skilled in the art that the features of the present invention could be incorporated into a wide variety of connector designs for switching any type of electrical signal. It is obvious that many other embodiments, which will be readily apparent to those skilled in the art, may be made without departing materially from the spirit and scope of this invention.

What is claimed is:

1. An electrical connector comprising:

an outer shell; and a cam shell disposed over said outer shell, said cam shell having at least one switch actuating cam extending radially from an outer surface thereof;

wherein upon mating of said connector with a mating connector, said cam shell is adapted to be rotated for thereby causing said at least one cam to contact a switch and thereby change said switch from an open state wherein current flow from said mating connector through a center conductor of said connector is interrupted, to a closed state wherein current is allowed to flow from said mating connector through said center conductor.

2. A connector according to claim 1, wherein said connector further comprises a cam shell spring disposed between said outer shell and said cam shell, said spring biasing said cam shell axially in a direction away from a mating end of said connector adapted to mate with said mating connector.

3. A connector according to claim 2, wherein said cam shell is axially extendable relative to said outer shell against the bias of said cam shell spring.

4. A connector according to claim 2, wherein said connector includes a retainer ring fixed to said outer shell, and wherein said cam shell spring has a first end positioned against a shelf formed on said retainer ring and a second end positioned against a shelf formed on said cam shell.

5. A connector according to claim 1, wherein said connector further includes inner shell, said outer shell being disposed about said inner shell and being axially biased toward a mating end of said connector by a spring disposed between said inner shell and said outer shell.

6. A connector according to claim 5, wherein said inner shell includes portions defining openings therein, and wherein locking elements are disposed within said openings with portions thereof being forced radially inward beyond an inner surface of said inner shell by a first surface of said outer shell, said outer shell including a beveled surface adjacent said first surface, wherein upon axial movement of said outer shell away from said mating end said beveled surface aligns with said openings thereby allowing said locking elements to recede within said openings against said beveled surface for mating said connector with said mating connector.

7. A connector according to claim 5, wherein said connector further comprises a cam shell spring disposed between said outer shell and said cam shell, said spring biasing said cam shell axially in a direction away from a mating end of said connector adapted to mate with said mating connector.

8. A connector according to claim 7, wherein said cam shell is axially extendable relative to said outer shell against the bias of said cam shell spring.

9. A connector according to claim 7, wherein said connector includes a retainer ring fixed to said outer shell, and wherein said cam shell spring has a first end positioned against a shelf formed on said retainer ring and a second end positioned against a shelf formed on said cam shell.

10. An electrical connector comprising:

an inner shell;

an outer shell disposed over said inner shell and being axially biased toward a mating end of said connector by a spring disposed between said inner shell and said outer shell;

a cam shell disposed over said outer shell, said cam shell having at least one switch actuating cam extending radially from an outer surface thereof; and a cam shell spring disposed between said outer shell and said cam shell, said cam shell spring biasing said cam shell axially in a direction away from said mating end;

wherein upon mating of said connector with a mating connector, said cam shell is adapted to be rotated for thereby causing said at least one cam to contact a switch and thereby change said switch from an open state wherein current flow from said mating connector through a center conductor of said connector is interrupted, to a closed state wherein current is allowed to flow from said mating connector through said center conductor; and wherein said inner shell includes portions defining openings therein, and wherein locking elements are disposed within said openings with portions thereof being forced radially inward beyond an inner surface of said inner shell by a first surface of said outer shell, said outer shell including a beveled surface adjacent said first surface, wherein upon axial movement of said outer shell away from said mating end said beveled surface aligns with said openings thereby allowing said locking elements to recede within said openings against said beveled surface for mating said connector to said mating connector.

11. A connector according to claim 10, wherein said cam shell is axially extendable relative to said outer shell against the bias of said cam shell spring.

12. A connector according to claim 11, wherein said connector includes a retainer ring fixed to said outer shell, and wherein said cam shell spring has a first end positioned against a shelf formed on said retainer ring and a second end positioned against a shelf formed on said cam shell.

* * * * *